US008324811B1

(12) United States Patent
Fuks et al.

(10) Patent No.: US 8,324,811 B1
(45) **Date of Patent: *Dec. 4, 2012**

(54) MAGNETRON HAVING A TRANSPARENT CATHODE AND RELATED METHODS OF GENERATING HIGH POWER MICROWAVES

(75) Inventors: Mikhail Fuks, Albuquerque, NM (US); Edl Schamiloglu, Albuquerque, NM (US)

(73) Assignee: STC.UNM, Albuquerque, NM (US)

( * ) Notice: Subject to any disclaimer, the term of this patent is extended or adjusted under 35 U.S.C. 154(b) by 322 days.

This patent is subject to a terminal disclaimer.

(21) Appl. No.: 12/710,041

(22) Filed: Feb. 22, 2010

Related U.S. Application Data

(63) Continuation-in-part of application No. 11/462,561, filed on Aug. 4, 2006, now Pat. No. 7,696,696.

(60) Provisional application No. 60/705,169, filed on Aug. 4, 2005.

(51) Int. Cl.
*H01J 25/50* (2006.01)

(52) U.S. Cl. ..... 315/39.51

(58) Field of Classification Search ..... 315/39.51, 315/39.53, 39.55, 39.57, 39.59, 39.63, 39.65, 315/39.71, 39.75, 39.77
See application file for complete search history.

(56) References Cited

U.S. PATENT DOCUMENTS 6,005,347 A * 12/1999 Lee ..... 315/39.63
6,538,386 B2 * 3/2003 Small ..... 315/39.51
6,872,929 B2 3/2005 Neculaes et al.
6,921,980 B2 7/2005 Nakanishi et al.
7,265,360 B2 * 9/2007 Baker et al. ..... 250/393
2004/0206751 A1 10/2004 Neculaes et al.
2004/0206754 A1 10/2004 Neculaes et al.

OTHER PUBLICATIONS

Fuks et al., "Operation of a Relativistic Magnetron with a 'Cut Cathode'", Abstract from IEEE Conference Record-Abstracts, The 31st IEEE International Conference on Plasma Science, Jun. 28-Jul. 1, 2004, Baltimore, MD, 4P7, p. 277.
Fuks et al., "Improvement of the Output Characteristics of Relativistic Magnetrons", The Papers of Joint Technical Meeting on Plasma Science and Technology and Pulsed Power Technology, IEEE Japan, Aug. 5-6, 2004, Maui, HI, pp. 71-76.
Schamiloglu, "Relativistic Magnetron Powered Using a Transparent Cathode", Presentation given at 2005 IEEE International Pulsed Power Conference, Jun. 14, 2005, Monterey, CA, (21 pages).
Fuks et al., "Rapid Onset of Oscillations in a Magnetron with a Transparent Cathode", Abstract from IEEE Conference Record-Abstracts, 2005 IEEE International Conference on Plasma Science, Jun. 20-23, 2005, Monterey, CA, 2P21, p. 206.
Prasad et al., "Prospects for Long Pulse Generation with a Magnetron Using a Transparent Cathode", Abstract from IEEE Conference Record-Abstracts, 2005 IEEE International Conference on Plasma Science, Jun. 20-23, 2005, Monterey, CA, 7B7, p. 353.
Prasad et al., "A Possibility of Long Pulse Generation in a Magnetron with Transparent Cathode", Poster Session Presentation at 2005 IEEE International Conference on Plasma Science, Jun. 20-23, 2005, Monterey, CA (14 pages).

(Continued)

*Primary Examiner* — Minh D A
(74) *Attorney, Agent, or Firm* — MH2 Technology Law Group LLP

(57) ABSTRACT

A cathode for use in a magnetron may include a plurality of longitudinally oriented emitter regions disposed around a longitudinal axis of the cathode. Each emitter region can be configured to emit electrons and adjacent emitter regions can be separated from one another by openings. The emitter regions can be configured to promote simultaneous cathode priming, magnetic priming, and electrostatic priming.

22 Claims, 10 Drawing Sheets

OTHER PUBLICATIONS

Fuks et al, "Rapid Onset of Oscillations in a Magnetron with a Transparent Cathode", Presentation from 2005 IEEE International Conference on Plasma Science (ICOPS), Session 2P-Poster Session II, Jun. 21, 2005, Monterey, CA, (18 pages).

Fuks et al., "Rapid Start of Oscillations in a Magnetron with a 'Transparent' Cathode", Physical Review Letters, 95, Nov. 11, 2005, pp. 205101-1-205101-4.

* cited by examiner

MAGNETRON HAVING A TRANSPARENT CATHODE AND RELATED METHODS OF GENERATING HIGH POWER MICROWAVES

CROSS-REFERENCE TO RELATED APPLICATIONS

This application is a Continuation-In-Part of and claims the benefits of priority of U.S. Ser. No. 11/462,561, filed on Aug. 4, 2006, now U.S. Pat. No. 7,696,696, which claims the benefit of priority to U.S. Provisional Application No. 60/705,169, filed on Aug. 4, 2005, which are each incorporated by reference herein in their entirety.

STATEMENT REGARDING FEDERALLY SPONSORED RESEARCH OR DEVELOPMENT

This invention was made with Government support under Grant No. F49620-01-1-0354 and FA9950-05-1-0300, awarded by the Air Force Office of Scientific Research. The Government has certain rights in the invention.

FIELD OF THE INVENTION

The present invention relates generally to magnetrons and, more particularly, to novel cathodes to improve the performance of relativistic and conventional magnetrons.

BACKGROUND OF THE INVENTION

Magnetrons are widely used as powerful and compact sources for the generation of high power microwaves in a variety of applications. Such applications may include, but are not limited to, microwave ovens, telecommunications equipment, lighting applications, radar applications, and military and weapons applications, for example.

A typical conventional magnetron structure is a coaxial vacuum diode with a cathode having a solid cylindrical surface and an anode consisting of cavities forming an azimuthally periodical resonant system. In many designs, resonator cavities of various shapes are cut into the internal surface of the anode, for example, in a gear tooth pattern. During operation, a steady axial magnetic field fills the vacuum annular region between the cathode and anode, and a voltage is applied between them to provide conditions for microwave generation. Transverse electric-type (TE) eigenmodes of the resonant system are used as operating waves. Usually two types of oscillations are used, the $\pi$-mode (with opposite directions of electric field in neighbor cavities) and the $2\pi$-mode (with identical directions of electric field in all cavities). The frequency of the generated microwaves is based in part on the number and shape of the resonator cavities, and the design features of the anode and cathode.

A cross-sectional view of a conventional well-known A6 magnetron modeled using the "MAGIC" particle-in-cell (PIC) code is illustrated in FIG. 1. As shown, a conventional magnetron comprises an anode 10, a cathode 20, which is a solid cylindrical structure, and resonator cavities 15. In this example, a waveguide 40 is located in one of resonator cavities 15 in order to extract the generated microwaves. A dielectric 40*a* also may be present in the waveguide 40. There are other ways known to those skilled in the art for extracting the microwaves as well, such as, for example, axially using diffraction output.

Electrons emitted from the cathode 20 form a solid flow drifting around a cathode with velocity determined by the applied voltage and magnetic field. When the azimuthal phase velocity of one of eigenmodes of the resonant system is close to the azimuthal drift velocity of the electrons, energy of electrons is transferred to this electromagnetic wave. As the wave gains energy, fields of the wave back-react on the electron charge cloud to produce spatial bunching of the electrons, which in turn reinforces the growth of the wave.

Magnetrons are either of the hot (thermionic) cathode type, which typically operate at voltages ranging from a few hundred volts to a few tens of kilovolts, or of the cold cathode type, with secondary electron emission or explosive emission, the latter of which are typically used in relativistic magnetrons, which operate at high voltage (hundreds kilovolts) and enable the generation of very high power microwaves.

For many applications, such as, for example, telecommunications, radars, but especially for military and weapons, it may be desirable to provide fast start of oscillations. The start time of oscillations of a magnetron is determined by two factors, 1) the start conditions, which give the initial impetus to the development of oscillations, and 2) the rate of buildup, that is, the growth rate of oscillations.

In a magnetron with a conventional solid cathode (with uniform electron emission), the initial noise level, which is about $10^{-10}$ of the energy of electrons, provides an initial impetus to the development of instabilities in the electron flow that is associated with the appearance of oscillations. This process may begin the forming of the electron flow modulation many tens of cyclotron periods later because of the relatively low noise level.

The rate of buildup is determined by an azimuthal electric field of the operating wave in the electron flow. In a magnetron with a solid cathode, that field is proportional to the thickness of the electron flow and equals zero on the metal cathode surface. Therefore, to provide a fast rise time of oscillations, increasing the thickness of the electron flow may be desirable. However, such an increase in thickness may lead to decreasing efficiency of the energy transfer. Moreover, attempts to increase the efficiency and output power of a conventional magnetron by increasing the voltage and magnetic field (that retains the closeness of phase velocity of the operating wave and drift velocity of electrons, which is the necessary condition for microwave generation, and decreases the thickness of the electron flow) ultimately may lead to degradation of output characteristics. This may occur because the azimuthal electric field of the operating wave, which is responsible for a capture of electrons to the anode, becomes too small.

It also may be difficult to generate long radiation pulse lengths with conventional relativistic magnetrons due to closure of the anode-cathode gap by plasma from explosive emission cathodes. Plasma interferes with the electromagnetic operation of the magnetron, either by creating a shorted current path, or by detuning the resonant cavities 15.

One approach that has been utilized in an effort to improve microwave production includes modifying the cathode surface to obtain a cathode with non-uniform emission that promotes a faster appearance of favorable modulation of the electron flow ("cathode priming") than in the case of a cathode with uniform emission.

Another approach includes periodically perturbing the DC axial magnetic field by placing permanent magnets around the resonant system. This approach ("magnetic priming") leads to increasing the electron flow modulation.

However, although these conventional approaches (cathode priming and magnetic priming) can provide a stronger initial impetus for the development of the electron flow modulation and thereby its faster development, they may not address many of the deficiencies and/or desirable features noted above. By way of example, and not limitation, the conventional approaches may not achieve sufficient shortening of the time to development of oscillations, which in part is determined by the rate of buildup. Moreover, these conventional approaches may not improve magnetron efficiency and/or address the issue of plasma closure.

SUMMARY OF THE INVENTION

Based on the various above-mentioned deficiencies of conventional magnetron designs, it may be desirable to improve upon conventional magnetron designs. For example, it may be desirable to provide a magnetron design that can generate longer microwave pulses. It may also be desirable to provide a magnetron design that provides a faster start to microwave production. It may further be desirable to provide a magnetron with higher efficiency.

These features can be achieved by the exemplary embodiments of the invention described herein. For example, the exemplary cathode designs described herein can simultaneously provide both "cathode priming" that provides a strong initial impetus for the appearance of modulation almost simultaneously with the appearance of electron emission and "magnetic priming" that leads to rapid development of the modulation. The exemplary cathode design described herein can also provide "electrostatic priming" that leads to rapid development of the modulation. The exemplary cathode designs also may provide fast transferring of energy of the electrons to the electromagnetic field. Further, a suitable choice of a cathode configuration may promote the excitation of a desired operating wave. Additionally, the exemplary embodiments can reduce the formation of plasma in the vacuum gap of the magnetron. Moreover, cathodes according to various exemplary embodiments of the invention can result in increased efficiency.

To achieve these and other advantages, and in accordance with the purposes of the invention, as embodied and broadly described herein, the invention can include a cathode for use in a magnetron which includes a plurality of longitudinally oriented emitter regions disposed around a longitudinal axis of the cathode, wherein each emitter region is configured to emit electrons. Adjacent emitter regions are separated from one another by openings.

In accordance with yet another exemplary embodiment, a magnetron can include an anode body and a cathode body concentrically disposed within the anode body. The cathode body can include a plurality of longitudinally oriented emitter regions disposed around a longitudinal axis of the cathode body, wherein each emitter region is configured to emit electrons, and wherein consecutive emitter regions are separated from one another by openings.

In accordance with further exemplary embodiments, a magnetron can include an anode and individual longitudinally oriented emitters periodically arranged around an imaginary cylindrical surface, the emitters being coaxially positioned within the anode.

It is to be understood that both the foregoing general description and the following detailed description are exemplary and explanatory only and are not restrictive of the invention.

BRIEF DESCRIPTION OF THE DRAWINGS

The accompanying drawings, which are incorporated in and constitute a part of this specification, illustrate embodiments of the invention and together with the description, serve to explain certain principles. In the drawings.

DESCRIPTION OF EXEMPLARY EMBODIMENTS

Figure 1:
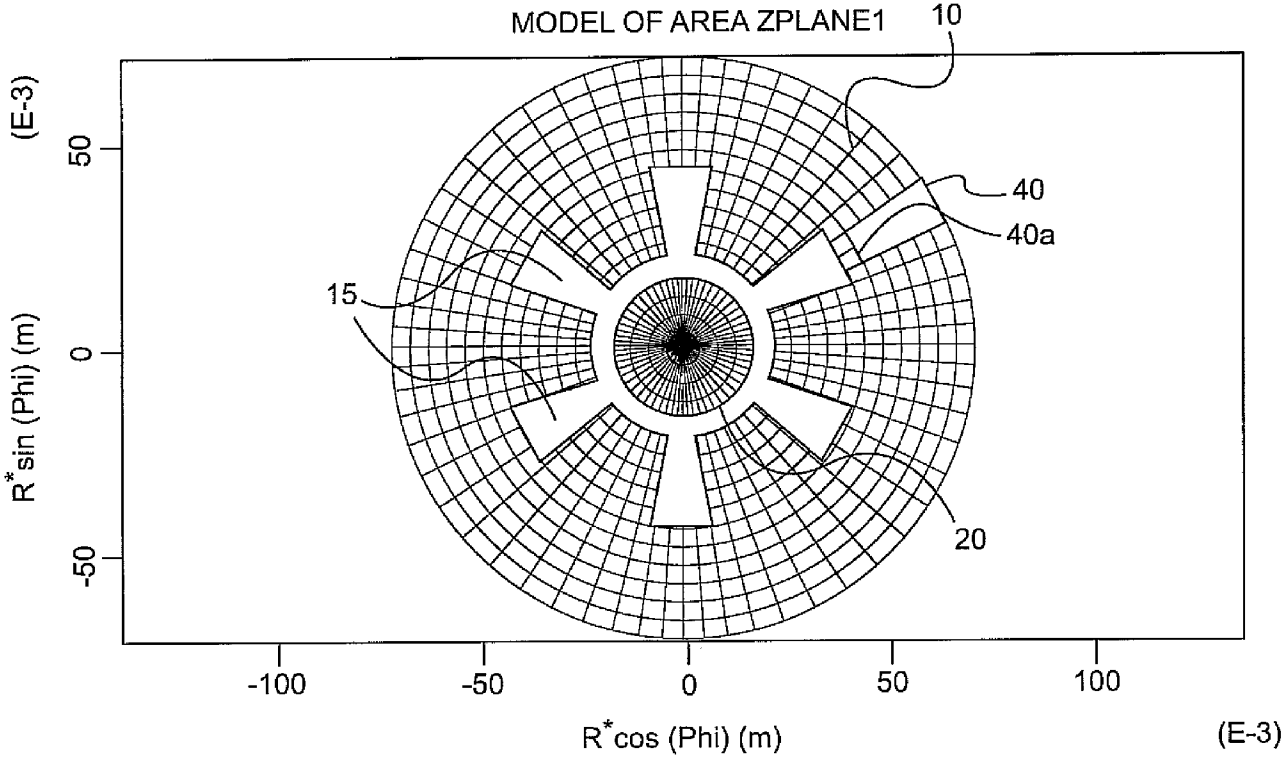
FIG. 1 is a cross-sectional view of a simulation model of a conventional A6 magnetron.

To achieve some of the advantages and desirable features noted above, the inventors discovered that by permitting the wave field in a conventional or relativistic magnetron to penetrate to the axis of the device so that significant azimuthal wave electric field in the electron flow formed around the cathode would be present to more rapidly transfer energy of the bunched electron flow to the electromagnetic field. The practical manifestation according to various exemplary embodiments includes replacing a solid cathode with separate longitudinally oriented emitters arranged on an imaginary cylindrical surface. For relativistic magnetrons, this can be realized, for example, by a hollow or tubular cold cathode, from which longitudinal strips are removed, thereby leaving a number of discrete emitters. The individual emitters can be evenly spaced, or grouped in bunches forming periodical emitter structures. Such cathodes according to exemplary aspects of the invention simultaneously and self-consistently provide "cathode priming", "magnetic priming", and "electrostatic priming." The cathode priming, which is caused by azimuthally periodic non-uniform emission, provides a strong initial impetus that results in the fast onset of electron bunching. At the same time, magnetic fields around each emitter, which are caused by longitudinal currents along the emitters, form an azimuthally periodic magnetic field, thereby promoting the fast gain of electron bunches (magnetic priming) when the electron flow rotates in this periodic field. Likewise, electrostatic fields around the individual emitters, which are caused by the applied voltage between the transparent cathode and the anode block, and appear as a periodic perturbation along the azimuthal direction of electron flow, further enhances the bunching process and spoke formation. Therefore, magnetrons using the cathodes according to exemplary aspects of the invention provide both a faster start and growth of oscillations compared with conventional and relativistic magnetrons, or magnetrons with solid cathodes using only cathode and/or magnetic priming. The number of discrete emitters, their configurations (e.g., shapes and sizes), and azimuthal location can be varied to achieve various operating requirements, and in particular, to excite the desired operating wave for which the mutual symmetry of the applied resonant system and emitters provide the most favorable condition for interaction with the electron flow. The strong synchronous azimuthal electric field acts on the electron flow of any thickness, which may result in increasing the efficiency and output power by consistently increasing the voltage and magnetic field. This differs from magnetrons with solid cathodes, in which increasing the voltage and magnetic field ultimately leads to degradation of the output characteristics because of the weakening azimuthal electric field of the operating wave, which can not capture electrons from narrowing electron flow to the anode.

In accordance with various exemplary embodiments described herein, a magnetron having a so-called "transparent cathode" may result in fields of TE-modes, which are used as operating waves in magnetrons, which penetrate through an imaginary cylindrical surface at which discrete emitters are periodically spaced. Because of this, the azimuthal electric field of the operating wave is relatively strong near the cathode surface providing rapid drift of electrons to the anode, along with rapid buildup of oscillations. As discussed above, because of the weak dependence of the value of the electric field in the electron flow on its thickness, magnetron efficiency and radiation power are increased when the applied voltage and magnetic field are consistently increased. A relativistic magnetron having a transparent cathode according to various exemplary embodiments also may operate with longer pulse because cathode plasma can propagate in all directions from individual emitters, thereby decreasing the plasma's density and velocity in the interaction space in comparison with a magnetron having an explosive emitting cathode with a solid surface in which the plasma propagates only in a direction toward the anode.

Further, a magnetron having a transparent cathode in accordance with various exemplary embodiments can give a strong initial impetus for favorable modulation of an electron flow by selecting a suitable number and position of the emitters (e.g., so as to achieve cathode priming). Longitudinal currents along the emitters produce magnetic fields around each emitter that form a periodical magnetic field. In addition, the emitters constitute an electrostatic perturbation along the direction of electron flow. Thus, cathode priming, magnetic priming, and electrostatic priming can be achieved in magnetrons according to various embodiments.

The above effects have been studied through analytical methods and computer simulations. Some of the results of these studies are further detailed in the description and exemplary embodiments below.

Reference will now be made in detail to exemplary embodiments of the invention, which are illustrated in the accompanying drawings. Wherever possible, the same reference numbers will be used throughout the drawings to refer to the same or like parts.

Figure 2:
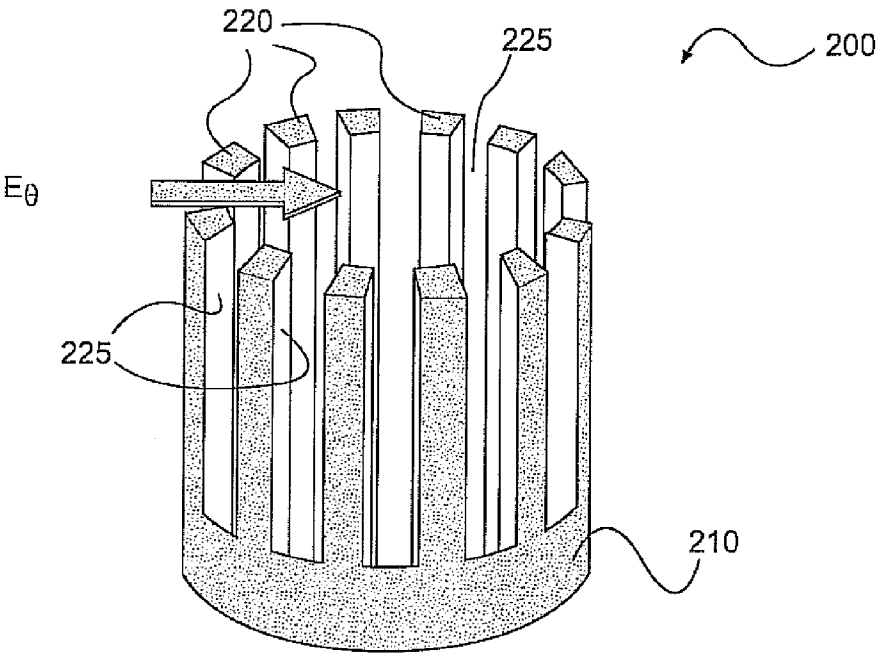
FIG. 2 is a schematic perspective view of an exemplary embodiment of a cathode according to an aspect of the invention.

An exemplary embodiment of a cathode according to an aspect of the invention is schematically illustrated in FIG. 2. As shown in FIG. 2, the cathode 200 has a body 210 which includes a number of separate emitter regions 220. The emitter regions 220 are consecutively disposed around a longitudinal axis of the cathode body 210 such that an imaginary envelope surface surrounding the emitter regions 220 forms a substantially hollow cylindrical structure. In the exemplary embodiment shown in FIG. 2, the emitter regions 220 are spaced from each other at substantially uniform intervals around the perimeter of the cathode body 210. Thus, empty regions (openings) 225 between consecutive (e.g., adjacent) emitter regions 220 are formed. The empty regions 225 permit the passage of electromagnetic field of the TE-modes, which have no longitudinal component of electric field; such that the field "penetrates" the cathode 200 up to the longitudinal axis of the cathode body 210. Accordingly, the cathode 200 can be referred to as a "transparent" cathode.

Figure 6:
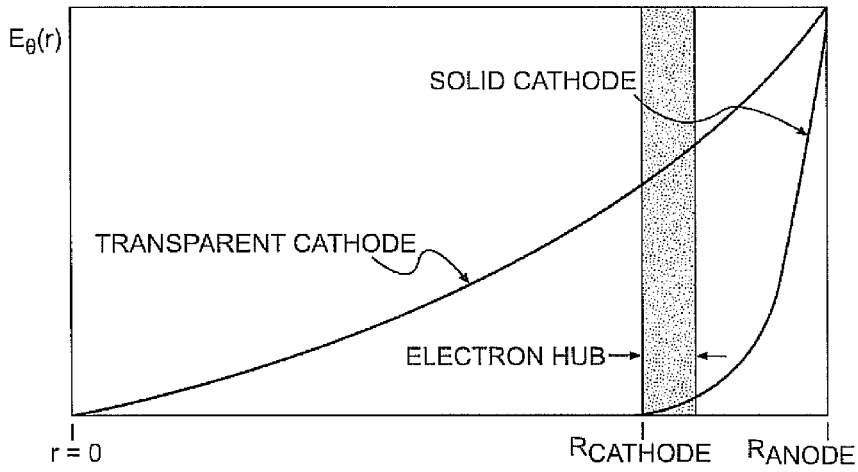
FIG. 6 is a graph showing a comparison of the azimuthal electric field of the operating wave as a function of radius for a magnetron with a transparent cathode according to an aspect of the invention and for a conventional magnetron with a solid cathode.

The penetrating azimuthal component of the electric field $E_\theta$, which is responsible for the velocity of transferring energy of electrons to the electromagnetic field, is much stronger in the electron flow around the transparent cathode than in the flow around the solid cathode (as shown in FIG. 6). This effect contributes significantly to achieving the fast start of oscillations and improving magnetron efficiency. FIG. 6 illustrates a chart comparing the azimuthal electric field generated in a magnetron using the "transparent" cathode according to an embodiment of the invention and the azimuthal electric field generated in a conventional magnetron with a solid cathode structure. As shown by the two curves in FIG. 6, in a magnetron using the transparent cathode according to an embodiment of the invention, the amplitude of the azimuthal electric field, $E_\theta$, is larger throughout the electron hub as compared with that of a magnetron using a solid cathode. The electron hub represents the thickness of the electron flow in the gap (e.g., annular space) between the cathode outer surface and the anode inner surface.

As also shown in the exemplary embodiment of FIG. 2, the emitter regions 220 can be longitudinally oriented with a strip-like configuration and be substantially parallel to one another. The number, azimuthal position with respect to anode resonant cavities and configuration of the emitter regions 220 can be selected so as to achieve desirable operating characteristics of the magnetron. Additionally, according to another exemplary embodiment, not shown, more than one emitter region may be bunched together with consecutive periodically placed bunches of emitters being separated by empty spaces.

According to another exemplary embodiment (not shown) a cathode according to the invention can include a solid rod (e.g., a cylindrical rod) having a relatively small diameter disposed substantially coaxially with a longitudinal axis of the cathode and such that it is surrounded by the number of emitter regions. In other words, the rod can be disposed centrally of the hollow cylinder defined by the number of emitter regions. In some applications, such an inner rod, whether metal or dielectric, can provide additional advantages.

Although the exemplary embodiment of FIG. 2 shows a cathode 200 having twelve separated emitter regions 220, it should be understood that any number of emitter regions can be used and selected so as to achieve desired operation of the magnetron. To excite the desired operating wave, it may be desirable to select a number of emitters corresponding to the number of electron bunches in the electron flow modulation, which is inherent to the excited wave. For example, to excite the 7π-type of oscillations in a magnetron with 6 cavities, it may be desirable to use 3 emitters, whereas a transparent cathode with 6 emitters can promote excitation of 2π-type of oscillations.

Figure 3:
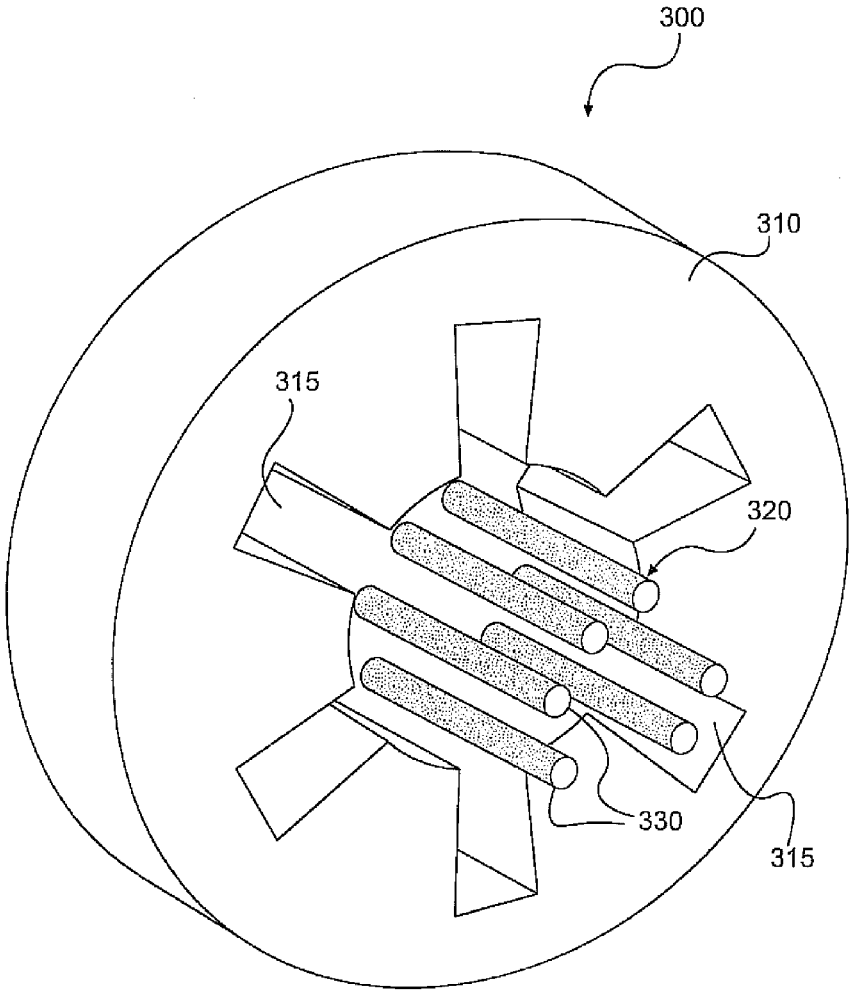
FIG. 3 is a perspective view of a simulation model of an exemplary embodiment of a magnetron according to an aspect of the invention.

It also is envisioned as within the scope of the invention to use any convenient configurations strips for the emitter regions. Emitters in the form of longitudinal strips are shown in FIG. 2. FIG. 3 illustrates another exemplary embodiment of a magnetron according to an aspect of the invention. The emitter regions 330 of FIG. 3 are in the form of longitudinally oriented, parallel cylinders. FIG. 3 further shows an anode 310 surrounding the cathode 320 in a concentric manner. The anode 310 includes resonator cavities 315. Those having ordinary skill in the art would understand that the emitters may have a variety of sizes and shapes other than those depicted in FIGS. 2 and 3.

Figure 4:
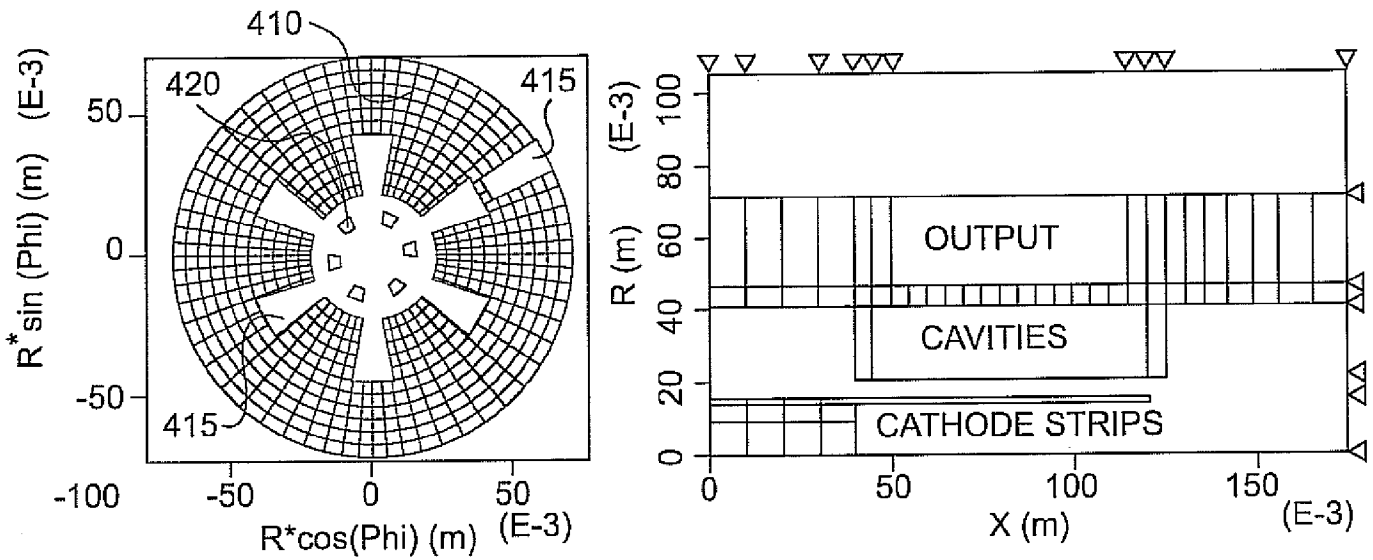
FIG. 4 shows two views of a simulation model of an exemplary embodiment of a magnetron according to an aspect of the invention.

FIG. 4 illustrates a simulation model of a magnetron incorporating a transparent cathode according to an exemplary embodiment of the invention.

The left side of FIG. 4 is a cross-sectional view of the magnetron simulation model taken in a plane perpendicular to the longitudinal axis of the magnetron and the right side of FIG. 4 shows a cross-sectional view in the plane parallel to the longitudinal axis. As shown in FIG. 4, the cathode 420 includes six discrete emitter regions 430 uniformly distributed around the longitudinal axis of the cathode 420. The number of the strips is chosen to be the same as the number of cavities 415 in an anode 410 in order to promote the excitation of the 2π-mode. In the simulation models of FIG. 4, the magnetron employs the configuration of the well-known conventional A6 magnetron (depicted in FIG. 1), except that the solid cathode is replaced by a "transparent" cathode in accordance with an exemplary embodiment of the invention. The A6 magnetron has a cathode radius of 1.58 cm and an anode block having 6 identical cavities. The inner radius of the anode block is 2.11 cm; the resonant cavities extend out 4.11 cm with an anode gap opening of 20°. The axial extent is 7.2 cm. In simulations of the magnetron of FIG. 4 operating in the 2 π-type oscillation mode, a transparent cathode with 6 emitters in the form of strips with azimuthal widths of 5°, 10° and 15°, respectively, was used.

Figure 5A:
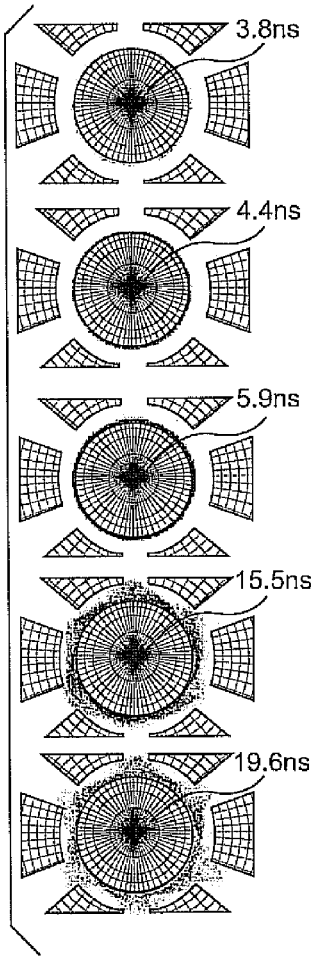
FIGS. 5A-5C show snapshots in time of electron particle distributions generated by simulation models of an A6 magnetron with a solid cathode with uniform emission (FIG. 5A), an A6 magnetron with a solid cathode having 6 enhanced emitter regions (conventional cathode priming) (FIG. 5B), and an A6 magnetron with a transparent cathode having 6 emitter regions (FIG. 5 C), respectively.
Figure 5B:
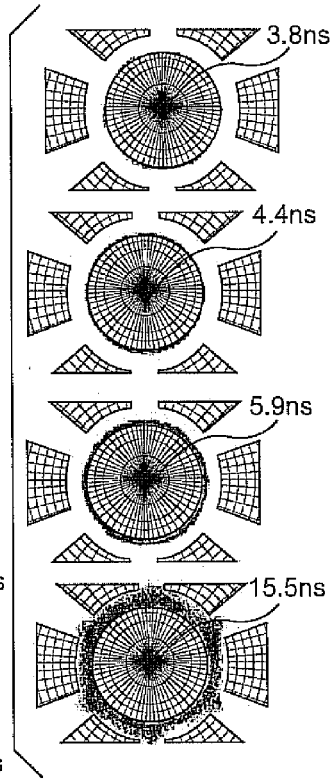
Figure 5C:
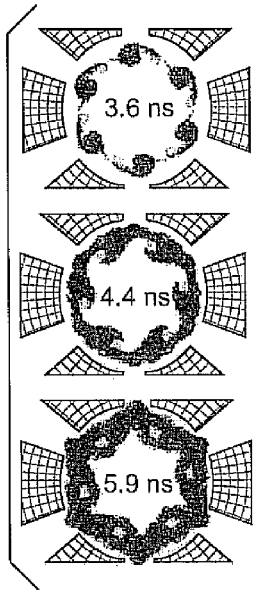

FIGS. 5A-5C illustrate snapshots in time of the phase space particle generation for a magnetron with the A6 configuration with different cathode structures. FIG. 5A shows snapshots in time of the phase space particle generation for an A6 magnetron having a solid cathode with uniform emission. FIG. 5B shows snapshots in time of the phase space particle generation for an A6 magnetron having a solid cathode with 6 modified longitudinal regions periodically placed in the azimuthal direction so as to result in enhanced emission regions (that is, a solid cathode with conventional cathode priming). FIG. 5C shows snapshots in time of the phase space particle generation for an A6 magnetron having a transparent cathode with 6 emitters each having an azimuthal width of 10°. The various times of each snapshot in FIGS. 5A-5C is indicated in nanoseconds in the center of each figure in the series. For each simulation, the applied voltage was 350 kV with a rise time 10 ns.

The results in FIGS. 5A-5C show that the modulated electron flow with 6 electron bunches corresponding to the operating 2π-type of oscillations forms during the first 5.9 ns in the magnetron with the transparent cathode (FIG. 5C). This electron bunching occurs several times faster than in a magnetron with a solid cathode with uniform emission in which the time of the formation is 19.6 ns (FIG. 5A), and of the magnetron with a solid cathode and conventional cathode priming in which the time of the formation is 15.5 ns (FIG. 5B).

Figure 7:
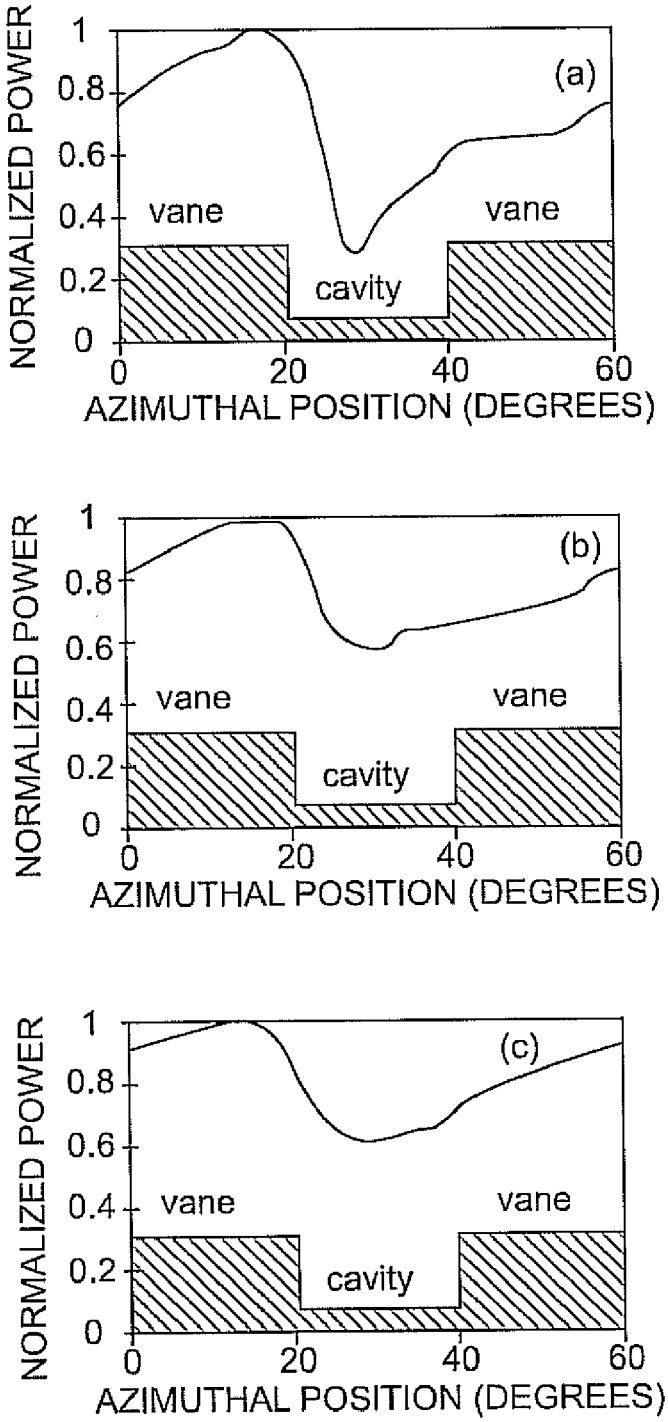
FIG. 7 shows the dependence of radiated power on the azimuthal position of the cathode emitters with respect to the resonant cavities for the transparent cathode magnetron simulation model of FIG. 4 for various azimuthal sizes of emitters including 5° (curve (a)), 10° (curve (b)), and 15° (curve (c))

To excite a desired operating wave it is important to choose not only a suitable number of emitters, but also their azimuthal position with respect to the anode resonant cavities. FIG. 7 shows curves of normalized power as function of azimuthal position for an A6 magnetron with a transparent cathode consisting of 6 emitters. FIG. 7 shows that the maximum radiation power corresponds to emitter positions that are slightly upstream relative to the direction of electron flow rotation. This is due to the simultaneous action of cathode priming, magnetic priming, and electrostatic priming. The direction of rotating electron flow is determined by the direction of the applied axial magnetic field. The difference between the maximum power and minimum power corresponding to the different azimuthal positions of emitters decreases as the azimuthal emitter width increases, as shown in the three different curves labeled (a), (b), and (c) of FIG. 7. The curve labeled (a) represents an azimuthal emitter width of 5°, the curve labeled (b) represents an azimuthal emitter width of 10°, and the curve labeled (c) represents an azimuthal emitter width of 15°.

Overall, based on the simulation studies of the magnetron model of FIG. 4 and other models of magnetrons utilizing a transparent cathode, it appears that the discrete regions of electron emission provided by the transparent cathode lead to fast start of oscillations. The fast start occurs due to several effects including stronger cathode priming, manifesting in rapid formation of pre-bunched electrons; magnetic priming, manifesting in rapid development of the electron bunches; electrostatic priming, manifesting in more rapid formation of electron spokes; and rapid capture of bunched electrons to the anode with a strong azimuthal electric field in the electron flow accompanied by rapid transferring of electron energy to the electromagnetic field.

Figure 8A:
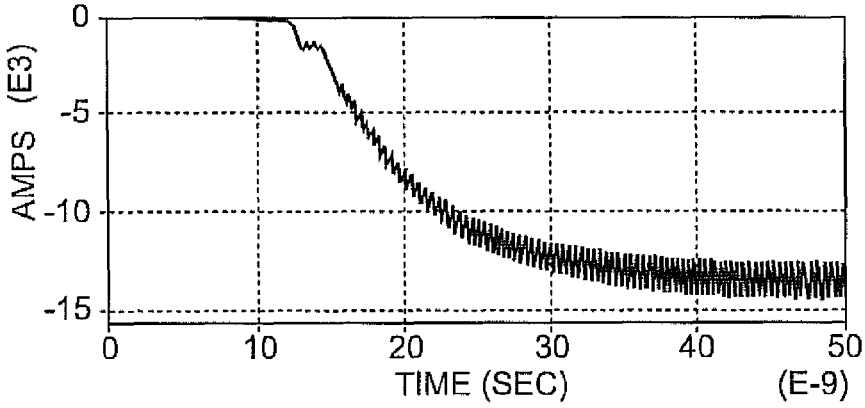
FIGS. 8A-8C show comparative anode current results for the A6 magnetron with different cathode configurations: with a solid cathode with uniform emission (FIG. 8A), with a solid cathode with non-uniform emission (FIG. 8B), and with a transparent cathode (FIG. 8C)
Figure 8B:
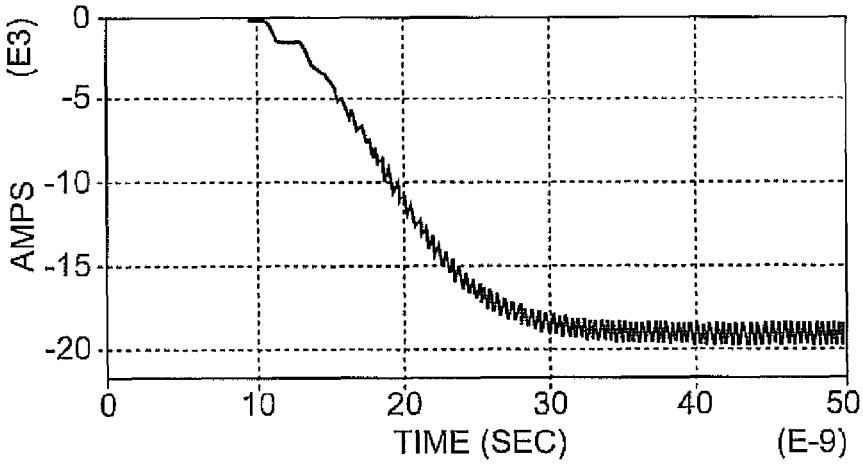
Figure 8C:
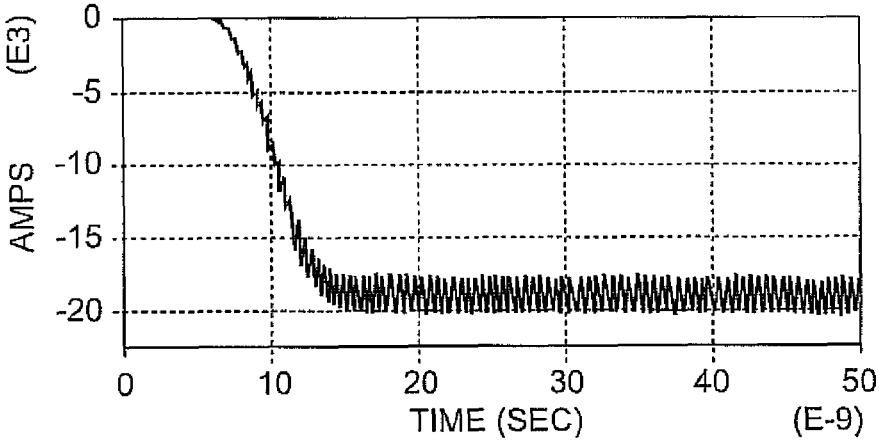
Figure 9A:
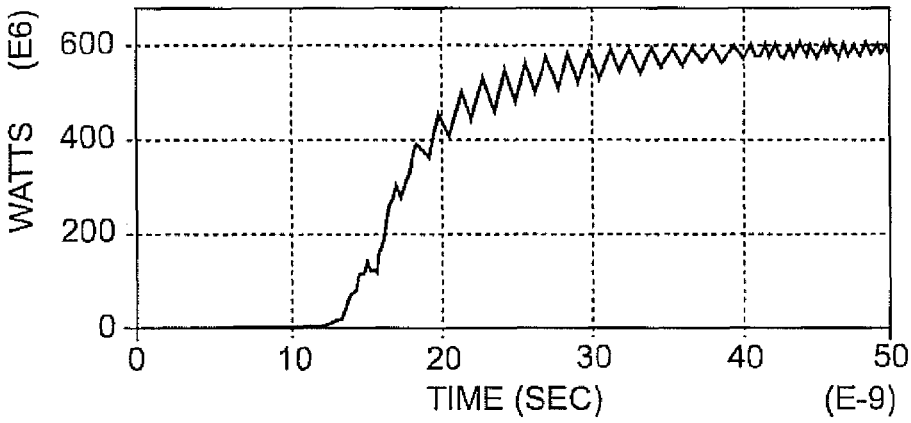
FIGS. 9A-9C show comparative power results for the A6 magnetron with different cathode configurations: with a solid cathode with uniform emission (FIG. 8A), with a solid cathode with non-uniform emission (FIG. 8B), and with a transparent cathode (FIG. 8C)
Figure 9B:
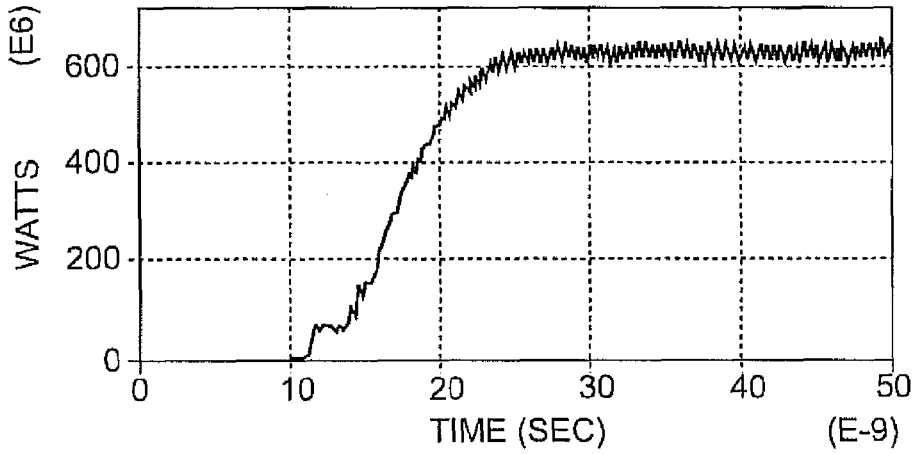
Figure 9C:
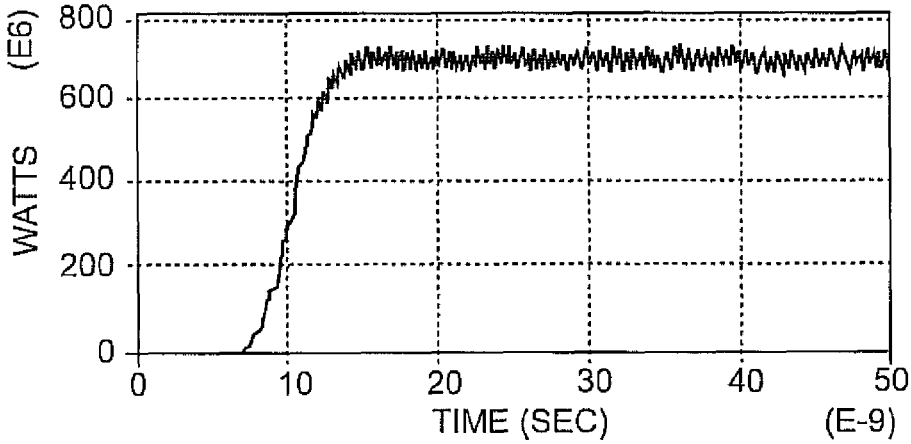

Further results of the simulation studies are shown in FIGS. 8A-8C and 9A-9C. In particular, FIGS. 8C and 9C show that the anode current and radiation power, respectively, reach their maximum at about 13 ns when a voltage of 350 kV with a rise time 10 ns is applied to the A6 magnetron with the transparent cathode. In comparison, the maximum anode current and radiation power, respectively, are reached about two times slower when the solid cathode with conventional cathode priming is used (FIGS. 8B and 9B), and about 3 times slower when the solid cathode with uniform emission is used (FIGS. 8A and 9A).

Figure 10:
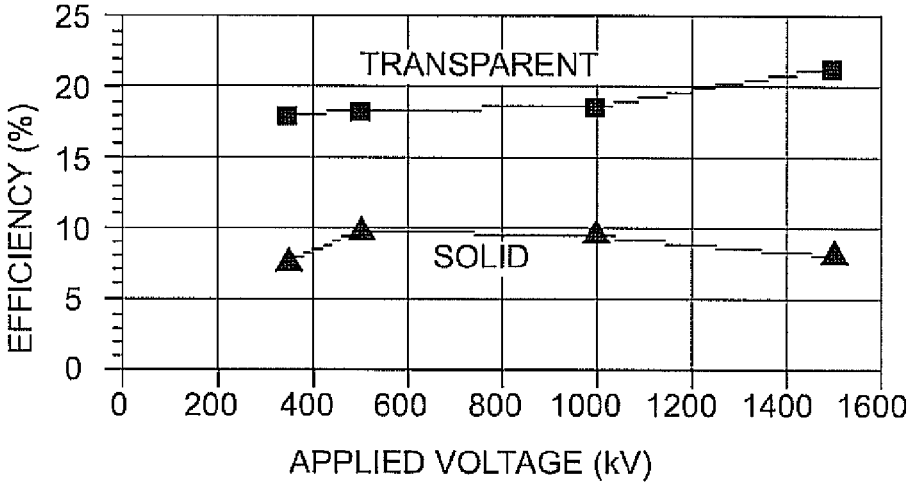
FIG. 10 shows the curves of efficiency when the applied voltage and magnetic field consistently increase for a conventional A6 magnetron and a transparent cathode magnetron in accordance with an exemplary embodiment.

FIG. 10 shows curves of the calculated efficiency as a function of applied voltage for the magnetron with the transparent cathode of FIG. 4 (upper curve with squares in FIG. 10) and a conventional A6 magnetron having a solid cathode with uniform emission (lower curve with triangles in FIG. 10). FIG. 10 demonstrates that the efficiency is higher in the transparent cathode embodiment than in the conventional A6 magnetron having a solid cathode and uniform emission. FIG. 10 also demonstrates that there is a tendency for the efficiency to increase when the applied voltage and magnetic field consistently increase for the transparent cathode embodiment, whereas the efficiency decreases for the conventional solid cathode magnetron.

Results of another simulation study using the MAGIC particle-in-cell code are reported in "The Papers of Joint Technical Meeting on Plasma Science and Technology and Pulsed Power Technology, IEE Japan," presented Aug. 5-6, 2004 ("the papers"), which is incorporated by reference in its entirety herein. In the study presented in the papers, the solid cathode of a conventional A6 magnetron was replaced with a thin-walled tubular cathode comprising 18 longitudinal, strip-like emitter regions disposed at substantially uniformly spaced intervals about the longitudinal axis of the cathode. Sections 4 and 4.1 of the papers provide further details of the parameters of the simulation study and the results. The results of this simulation study demonstrate, among other things, that using a "transparent" cathode in lieu of a solid cathode in the A6 magnetron can permit the anode-cathode gap space to be increased without negatively affecting electron capture to the anode. Such an opportunity can be important for relativistic magnetrons using explosive electron emission cathodes.

Overall, the various reported results discussed herein show that a magnetron according to an aspect of the invention in which the conventional solid cathode is replaced with a "transparent" cathode which permits the azimuthal electric field to penetrate the cathode and reach the longitudinal axis of the cathode and which has a discrete emitter region(s) for the emission of electrons from the cathode may overcome deficiencies that exist in conventional magnetron structures. For example, the magnetron structures according to the invention may provide higher efficiencies, higher output radiation, a faster start to microwave oscillation. Moreover, by permitting plasma to expand in all directions, problems associated with plasma closure may be alleviated. This would lead to longer pulse generation, Further advantageous results of using magnetrons according to exemplary aspects of the invention may include the ability to pre-bunch electrons into a desirable configuration prior to the onset of microwave generation.

As discussed above, various applications for the magnetrons according to exemplary aspects of the invention are envisaged, including but not limited to, use as sources for microwave ovens, lighting applications, telecommunications applications, military applications, high-resolution radar systems, and other applications in which high power microwave sources may be desirable.

It should be noted that sizes and configurations of various structural parts and materials used to make the above-mentioned parts are illustrative and exemplary only. One of ordinary skill in the art would recognize that those sizes, configurations, and materials can be changed to produce different effects or desired characteristics. For example, the number, shape, size, and/or positioning of the cathode emitter regions may be altered as desired and the various disclosed dimensions of the various magnetron structures also may be changed so as to achieve desired output characteristics. Although some of the exemplary embodiments disclosed used dimensions consistent with a conventional A6 magnetron, it should be understood that such dimensions are exemplary only and the various dimensions and configurations of the various parts of the magnetron can be altered in a manner so as to obtain desired operating characteristics. Further, it is envisioned that upon determining a desired operation of the magnetron, the number of discrete emitters, or groups of emitters bunched together in various azimuthal positions, the azimuthal widths of each emitter, the azimuthal orientation with respect to the anode cavities, and/or other design configurations can be varied to reach an optimal solution.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations. Other embodiments of the invention will be apparent to those skilled in the art from consideration of the specification and practice of the invention disclosed herein.

What is claimed is:

1. A cathode for use in a magnetron, the cathode comprising:

a plurality of longitudinally oriented emitter regions disposed around a longitudinal axis of the cathode, wherein each emitter region is configured to emit electrons, wherein adjacent emitter regions are separated from one another by openings, and wherein the emitter regions are configured to promote electrostatic priming.

2. The cathode of claim 1, wherein the emitter regions are configured to promote cathode priming and magnetic priming.

3. The cathode of claim 1, wherein the openings are configured to permit operating waves of magnetrons to pass between consecutive emitter regions to the longitudinal axis of the cathode.

4. The cathode of claim 1, wherein the openings are configured as longitudinal bands.

5. The cathode of claim 1, wherein the plurality of emitter regions define an envelope surface forming a thin-walled hollow cylindrical structure.

6. The cathode of claim 5, wherein the envelope surface defines a radius and wherein the cathode is configured such that an azimuthal electric field at the radius is significantly greater than an azimuthal electric field at a surface of a solid cathode having a radius equal to the radius of the cylindrical envelope surface defined by the emitter regions.

7. The cathode of claim 1, wherein each of the emitter regions has a strip-like configuration.

8. The cathode of claim 1, wherein each of the emitter regions has a substantially cylindrical configuration.

9. The cathode of claim 1, wherein the plurality of emitter regions are disposed substantially equidistantly around the longitudinal axis, or grouped together in bunches, forming an azimuthally symmetric orientation.

10. The cathode of claim 1, further comprising a rod of relatively small diameter, the rod being disposed substantially coaxially with a longitudinal axis of the cathode and being surrounded by the plurality of emitter regions.

11. The cathode of claim 1, wherein the plurality of emitter regions are configured to excite a desired operating mode.

12. The cathode of claim 11, wherein at least one of a number, size, shape, and position of the emitter regions is preselected to excite a desired operating mode.

13. The cathode of claim 1, wherein each emitter region is disposed slightly upstream relative to a direction of electron flow rotation.

14. A magnetron comprising the cathode of claim 1.

15. A magnetron, comprising:

an anode body; and a plurality of longitudinally oriented emitter regions arranged periodically around an imaginary cylindrical surface so as to excite a desired operating mode, wherein the emitter regions are coaxially positioned within anode, wherein each emitter region is configured to emit electrons, wherein consecutive emitter regions are separated from one another by openings, and wherein the emitter regions are configured to promote electrostatic priming.

16. The magnetron of claim 15, wherein the plurality of emitter regions are configured to promote cathode priming and magnetic priming.

17. The magnetron of claim 15, wherein the openings are configured to permit an electric field to azimuthally pass between the emitter regions and toward the longitudinal axis of the magnetron.

18. The magnetron of claim 15, wherein the plurality of emitter regions form a cathode body.

19. The magnetron of claim 15, wherein each of the emitter regions has a strip-like configuration.

20. The magnetron of claim 15, wherein the plurality of emitter regions are disposed substantially equidistantly around the longitudinal axis of the magnetron, or grouped together in bunches, forming an azimuthally symmetric orientation.

21. The magnetron of claim 15, wherein the plurality of emitter regions define an envelope surface forming a thin-walled hollow cylindrical structure.

22. The magnetron of claim 15, wherein the anode body comprises resonant cavities.

* * * * *